US007758022B1

(12) United States Patent
Wright et al.

(10) Patent No.: US 7,758,022 B1
(45) Date of Patent: Jul. 20, 2010

(54) PNEUMATIC CARPET STRETCHER

(76) Inventors: Robert Wright, 504 Maplewood Rd., Wayne, PA (US) 19087; Kevin Blaine, P.O. Box 315, Swarthmore, PA (US) 19081

( * ) Notice: Subject to any disclaimer, the term of this patent is extended or adjusted under 35 U.S.C. 154(b) by 294 days.

(21) Appl. No.: 11/901,011

(22) Filed: Sep. 13, 2007

(51) Int. Cl.
*B65H 77/00* (2006.01)

(52) U.S. Cl. ..... 254/201; 294/8.6

(58) Field of Classification Search ..... 254/201, 254/209, 212; 294/8.6
See application file for complete search history.

(56) References Cited

U.S. PATENT DOCUMENTS 4,008,879 A * 2/1977 Youngman ..... 254/201
5,145,225 A * 9/1992 Muller et al. ..... 294/8.6
5,472,170 A * 12/1995 Anasson ..... 254/212
5,938,182 A * 8/1999 Goodrich et al. ..... 254/209
6,371,446 B1 * 4/2002 Gauthier et al. ..... 254/201
6,669,173 B1 * 12/2003 Dunn ..... 254/201
7,140,597 B2 * 11/2006 Chien ..... 254/201
7,175,161 B2 * 2/2007 Hochmeyer et al. ..... 254/201
7,497,418 B1 * 3/2009 Mei et al. ..... 254/205

* cited by examiner

*Primary Examiner*—Emmanuel M Marcelo
(74) *Attorney, Agent, or Firm*—Emery L. Tracy

(57) ABSTRACT

A carpet stretcher for stretching carpet is provided. The carpet stretcher comprises a gripping portion having a first end and a second end and a pneumatic portion having a first end and a second end. An interchangeable moving head is releasably secured to the first end of the gripping portion with the moving head having a plurality of gripping mechanisms for gripping the carpet. A pneumatic actuator assembly is mounted to the pneumatic portion and securing the first end of the pneumatic portion to the second end of the gripping portion with the pneumatic actuator selectively moving the gripping portion in a general direction away from and toward the pneumatic portion. A compressed air line extends from a compressed air source to the pneumatic actuator assembly. A trigger mechanism selectively introduces compressed air to each of the pneumatic cylinders wherein as the trigger mechanism is actuated, the interchangeable head moves away from the pneumatic portion causing the carpet to be stretched.

17 Claims, 5 Drawing Sheets

PNEUMATIC CARPET STRETCHER

BACKGROUND OF THE INVENTION

1. Field of the Invention

This invention relates generally to a pneumatic carpet stretcher and, more particularly, the invention relates to a pneumatic carpet stretcher using compressed air to replace human effort in stretching carpet thereby effecting accurate and ergonomic carpet installation.

2. Description of the Prior Art

Carpets are typically installed in a manner to eliminate wrinkles, both during installation and during post installation usage. The installed condition is accomplished by imparting a preload (or stretch) within the flooring product. The elastic stretch prevents future wrinkles induced by the friction of traffic upon the floors.

The tools presently recommended by the "Carpet and Rug Institute" for installation of carpet is a "power stretcher" and a manual "knee-kicker". The most common form of a manual "knee-kicker" in use requires the operator to kneel on the floor with only one knee and violently kick the device with the other knee. Use of this style of device commonly causes debilitating repetitive stress injuries to the operator. Additionally, this style of device is incapable of holding or clamping any true elastic stretch obtained in the product since rebound occurs at the operator's knee.

SUMMARY

The present invention is a carpet stretcher for stretching carpet. The carpet stretcher comprises a gripping portion having a first end and a second end and a pneumatic portion having a first end and a second end. An interchangeable moving head is releasably secured to the first end of the gripping portion with the moving head having a plurality of gripping mechanisms for gripping the carpet. A pneumatic actuator assembly is mounted to the pneumatic portion and securing the first end of the pneumatic portion to the second end of the gripping portion with the pneumatic actuator selectively moving the gripping portion in a general direction away from and toward the pneumatic portion. A compressed air line extends from a compressed air source to the pneumatic actuator assembly. A trigger mechanism selectively introduces compressed air to each of the pneumatic cylinders wherein as the trigger mechanism is actuated, the interchangeable head moves away from the pneumatic portion causing the carpet to be stretched.

The present invention further includes a stretcher apparatus for stretching carpet and other sheet material. The stretcher apparatus comprises gripping means for gripping the carpet and other sheet material, which position can be adjusted with variable extensions to the main body, a main body secured to the gripping means, pneumatic means secured to the main body for causing the gripping means to move in a general direction away from the main body, pair means extending from a compressed air source to the pneumatic means, and trigger means for selectively introducing compressed air through the air means to the pneumatic means.

DETAILED DESCRIPTION OF THE PREFERRED EMBODIMENTS

Figure 1:
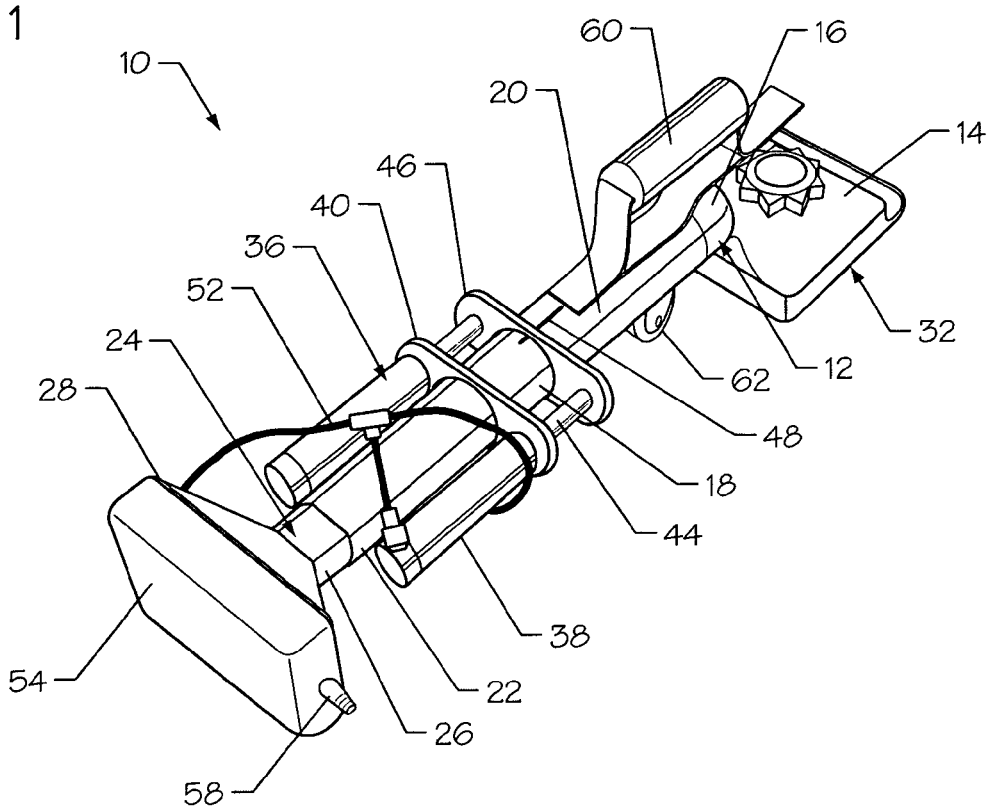
FIG. 1 is a front perspective view illustrating a pneumatic carpet stretcher, constructed in accordance with the present invention, with an actuator trigger embedded in a knee pad.
Figure 2:
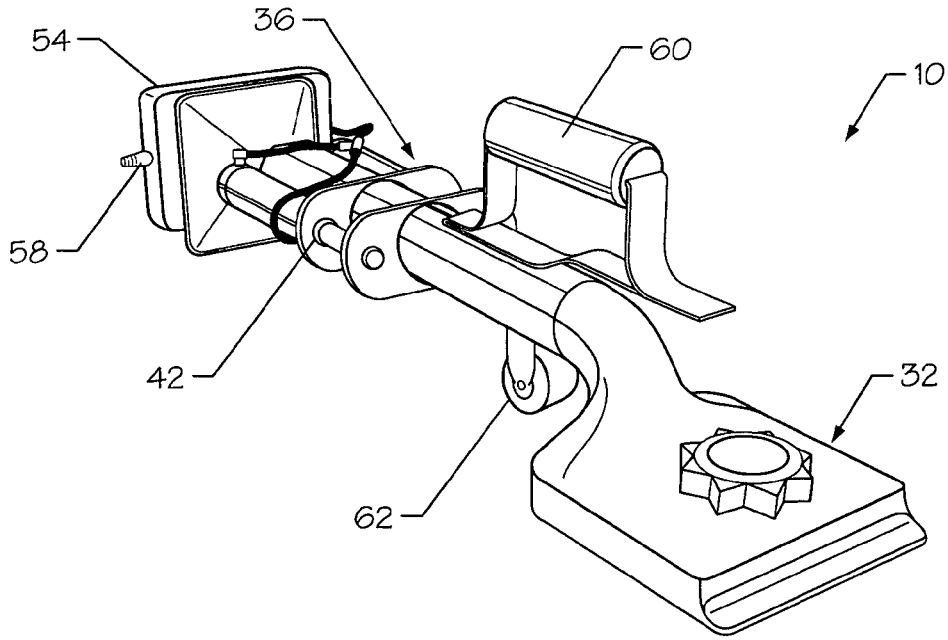
FIG. 2 is a rear perspective view illustrating the pneumatic carpet stretcher of FIG. 1, constructed in accordance with the present invention.
Figure 3:
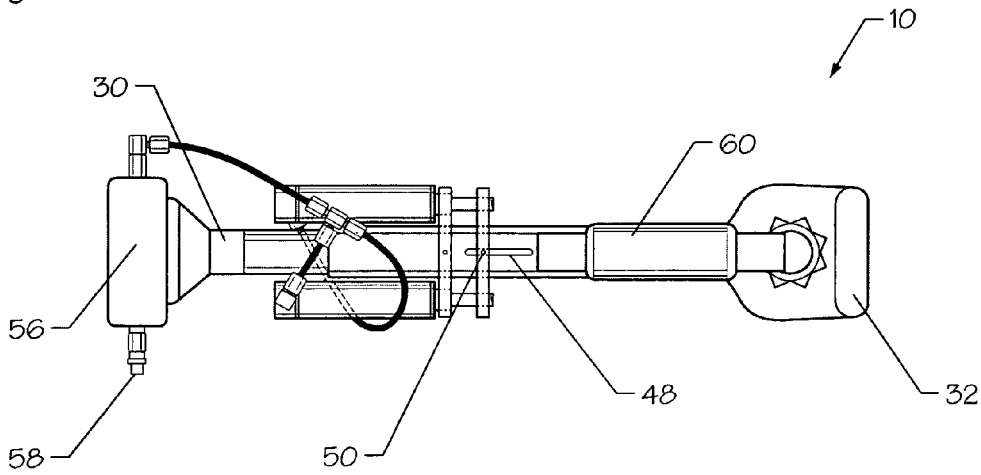
FIG. 3 is a top plan view illustrating the pneumatic carpet stretcher of FIG. 1, constructed in accordance with the present invention.
Figure 4:
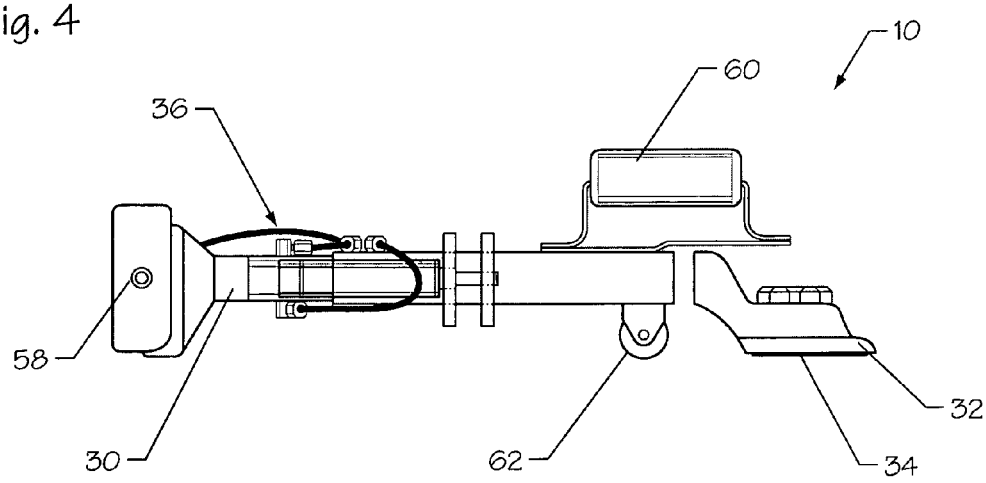
FIG. 4 is an elevational side view illustrating the pneumatic carpet stretcher of FIG. 1, constructed in accordance with the present invention.

As illustrated in FIGS. 1-10, the present invention is a pneumatic carpet stretcher, indicated generally at 10, for effecting accurate and ergonomic carpet installation. In short, the pneumatic carpet stretcher 10 of the present invention uses compressed air to replace human effort in stretching carpet and sheet goods. Use of the pneumatic carpet stretcher 10 permits faster installation speeds, better product control, and reduces operator strain and repetitive stress injuries to knees, lower back, ankles, and other parts of the body.

As illustrated in FIGS. 1-4, in a first embodiment of the present invention, the pneumatic carpet stretcher 10 has a gripping portion 12 having a first end 14 and a second end 16, a pneumatic portion 18 having a first end 20 and a second end 22, and a knee portion 24 having a first end 26 and a second end 28. The first end 26 of the knee portion 24 is receivable and movable in and out of the second end 22 of the pneumatic portion 18. An air shock 30 at the connection between the pneumatic portion 18 and the knee portion 24 provides resistance during use, as will be described in further detail below.

The pneumatic carpet stretcher 10 of the present invention further has an interchangeable moving head 32 releasably secured to the first end 14 of the gripping portion 12. The moving head 32 has a plurality of gripping mechanisms 34 for gripping the carpet or sheet material to be stretched, as will be described below.

The pneumatic carpet stretcher 10 of the present invention further includes a pneumatic actuator assembly 36 mounted to the pneumatic portion 18 and securing the first end 20 of the pneumatic portion 18 to the second end 16 of the gripping portion 12. The pneumatic actuator assembly 36 preferably has a pair of pneumatic cylinders 38 coupled to a rear plate 40. An aperture 42 in the rear plate 40 allows a piston 44 extending from the pneumatic cylinders 38 to move in a generally forward and reverse direction through the apertures 42. The pistons 44 are secured to a front plate 46 causing the front plate 46 to move in conjunction with the pneumatic cylinders 38. A slot 48 formed in the gripping portion 12 receives a pin 50 or the like mounted on the front plate 46 for contacting the second end 16 of the gripping portion 12. As the pneumatic cylinders 38 cause the pistons 44 to extend, the front plate 46 moves forward causing the gripping portion 12 to extend from the pneumatic portion 18 thereby stretching the carpet.

A compressed air line 52 extends from each of the pneumatic cylinders 38 to a knee pad 54 for introducing compressed air to each of the pneumatic cylinders 38. As the pistons 44 extend from the pneumatic cylinders 38, the front plate 46 moves in a general direction away from the pneumatic portion 18 causing the gripping portion 12 and, thus, the moving gripping head 32, to move forward causing the carpet to be stretched.

In addition, the pneumatic carpet stretcher 10 of the present invention includes the padded knee pad 54 mounted to the second end 28 of the knee portion 24 for communication with a knee. The knee pad 54 has an actuator trigger 56 embedded therein for actuating the pneumatic actuator assembly 36. In use, a user simply depresses the knee pad 54 with his or her knee thereby causing the pistons 44 to extend from the pneumatic cylinders 38. Upon release of the actuator trigger 56, the pistons 44 retract into the pneumatic cylinders 38. A coupling 58 extending from the knee pad 54 to a pneumatic source (not shown) provides the compressed air to the pneumatic actuator assembly 36.

In addition, a handle 60 is mounted to the pneumatic portion 18 and graspable by a user during operation. Furthermore, a wheel 62 mounted opposite the handle 60 to the pneumatic portion 18 allows the pneumatic carpet stretcher 10 to roll during stretching and relaxing of the carpet, when needed.

Figure 5:
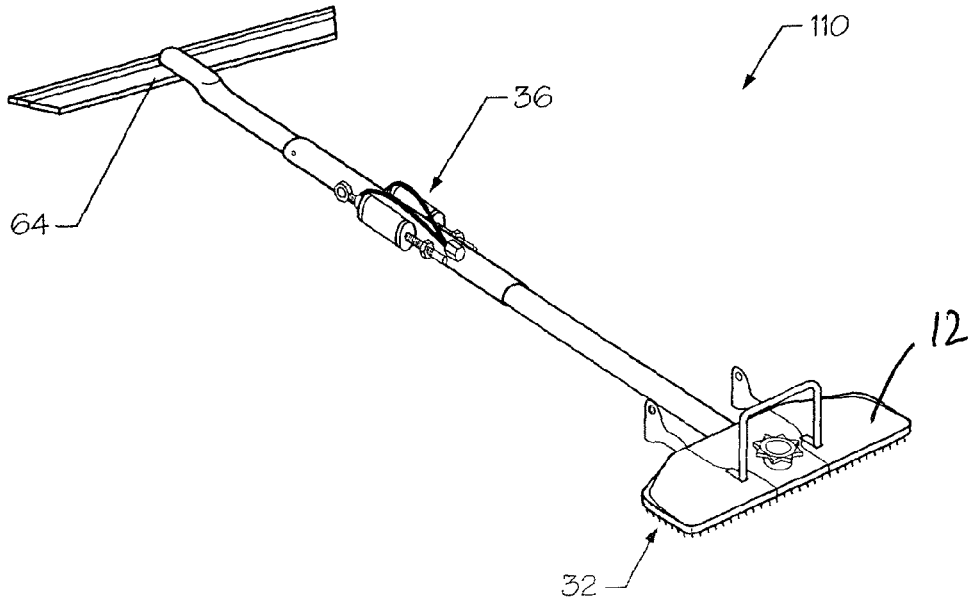
FIG. 5 is a perspective view illustrating another embodiment of the pneumatic carpet stretcher, constructed in accordance with the present invention, with an interchangeable thrust plate positionable against fixed objects.
Figure 6:
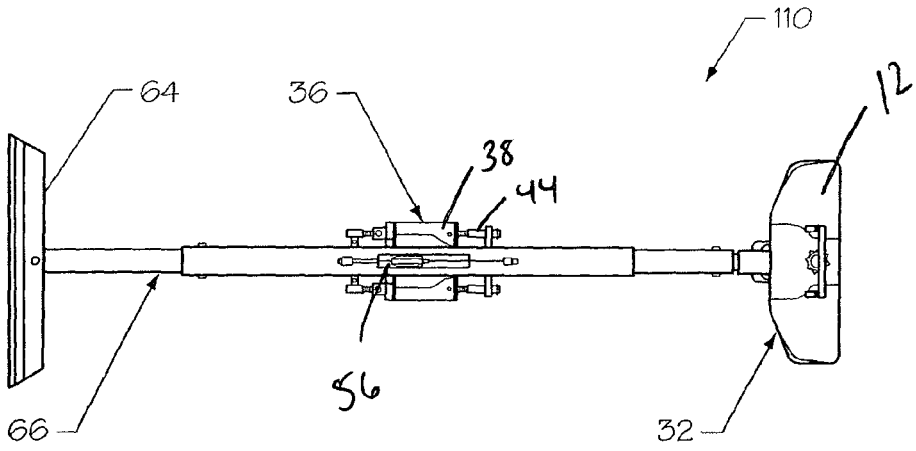
FIG. 6 is a top plan view illustrating the pneumatic carpet stretcher of FIG. 5, constructed in accordance with the present invention.
Figure 7:
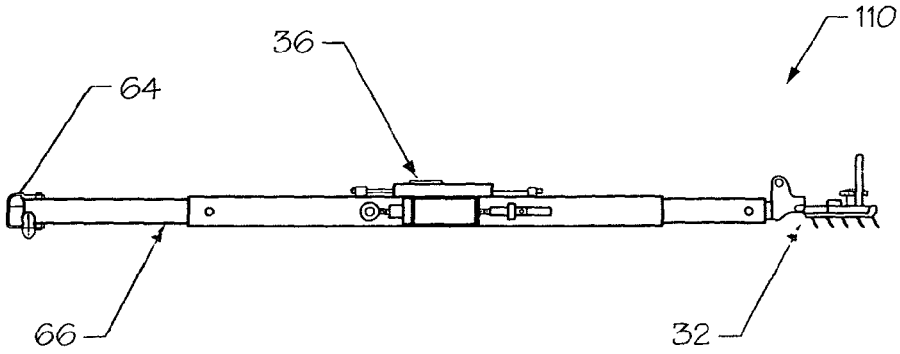
FIG. 7 is an elevational side view illustrating the pneumatic carpet stretcher of FIG. 5, constructed in accordance with the present invention.

As illustrated in FIGS. 5-7, in a second embodiment of the present invention, the pneumatic carpet stretcher 110 has an interchangeable thrust plate 64 positionable against fixed objects. Similar in operation to the first embodiment, the pneumatic carpet stretcher 110 of the second embodiment stretches the carpet or sheet goods by use of the air operated pneumatic actuator assembly 36. The actuator trigger 56 is positioned on or near the pneumatic actuator assembly 36 causes the gripping portion 12 to extend and retract the gripping head 32.

Instead of the knee pad 54, the pneumatic carpet stretcher 110 has the interchangeable thrust plate 64 for use against fixed points. The thrust plate 64 is secured to a variable length frame 66 allowing the user to adjust the distance between the thrust plate 64 and the pneumatic actuator assembly 36. Once positioned, the user positions the pneumatic carpet stretcher 110 with the gripping head 32 gripping the carpet or sheet material and the thrust plate 64 against the fixed point. Activation of the actuator trigger 56 causes the pistons 44 to extend from the pneumatic cylinders 38 stretching the carpet or sheet material. Releasing the actuator trigger 56 causes the pistons 44 to retract into the pneumatic cylinders 38 relaxing the carpet or sheet material. The thrust plate 64 imparts tool reaction to the fixed or rigid point.

Figure 8:
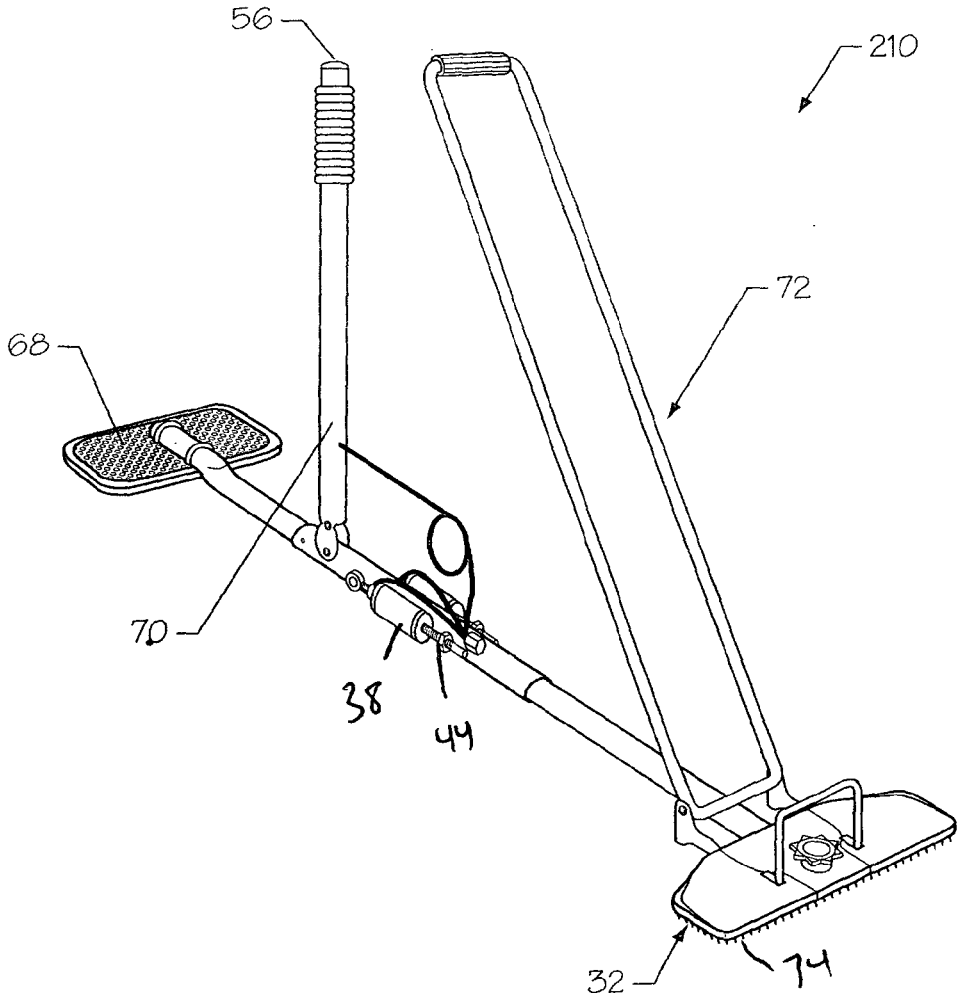
FIG. 8 is a perspective view illustrating still another embodiment of the pneumatic carpet stretcher, constructed in accordance with the present invention, with an operating stand and friction plate.
Figure 9:
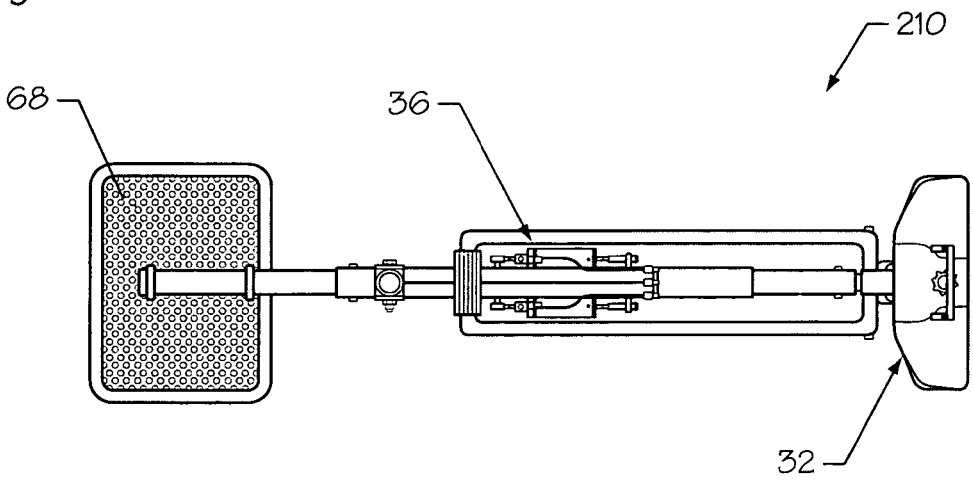
FIG. 9 is a top plan view illustrating the pneumatic carpet stretcher of FIG. 8, constructed in accordance with the present invention.
Figure 10:
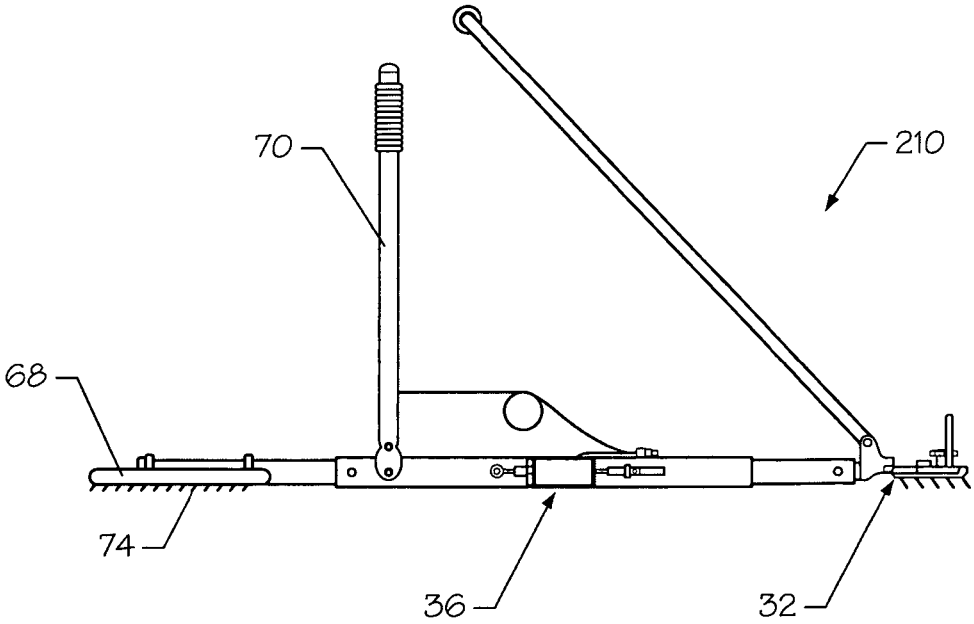
FIG. 10 is an elevational side view illustrating the pneumatic carpet stretcher of FIG. 8, constructed in accordance with the present invention.

As illustrated in FIGS. 8-10, in a third embodiment of the present invention, the pneumatic carpet stretcher 210 has an operating stand 68. Similar in operation to the first embodiment and the second embodiment, the pneumatic carpet stretcher 210 of the third embodiment stretches the carpet or sheet goods by use of the air operated pneumatic actuator assembly 36. The actuator trigger 56 is positioned on an extended rear handle 70 to extend and retract the gripping head 32.

Instead of the knee pad 54 or the thrust plate 64, the pneumatic carpet stretcher 210 has the operating stand 68 for allowing a user to stand thereupon. The operating stand 68 is secured to a variable length frame 72 allowing the user to adjust the distance between the operating stand 68 and the pneumatic actuator assembly 36. Once positioned, the user positions the pneumatic carpet stretcher 110 with the gripping head 32 gripping the carpet or sheet material and the operating stand 68 on the carpet with the user standing on the operating stand. Gripping teeth 74 on the bottom of the operating stand 68 provides further gripping. Activation of the actuator trigger 56 causes the pistons 44 to extend from the pneumatic cylinders 38 stretching the carpet or sheet material. Releasing the actuator trigger 56 causes the pistons 44 to retract into the pneumatic cylinders 38 relaxing the carpet or sheet material.

Similar to conventional tools, the moving head 32 of the pneumatic carpet stretcher 10, 110, 210 of each of the embodiments of the present invention the carpet or sheet goods to be installed. However, the pneumatic carpet stretcher 10 changes the conventional installation protocol at this point by using pneumatic power to replace manual operation via the simple trigger 56 control either embedded in the rear knee pad 54 or positioned along the forward handle. All of the elastic stretch within the flooring product, imparted by the pneumatic carpet stretcher 10 is then captured by the operator since the pistons 44 do not relax or rebound until the operator relieves the trigger 56.

The pneumatic carpet stretcher 10 of the present invention permits the amount of induced preload (or stretch) into any flooring product to be precisely controlled by varying actuation rates by either modulating pneumatic pressure or modulating the duration of applied force by trigger control. Further control or customization of the product installation is accomplished by interchanging the forward (moving) head 32 of the pneumatic carpet stretcher 10 with any variety of existing or new head types. The size and grip characteristics of the interchangeable heads 32 are selected to best match the properties of the material to be installed, such as, but not limited to, operating with a suction cup head or friction head for sheet goods (such as vinyl flooring products). Another feature that can be optimized to best accommodate the elastic properties of the installed material is the distance between the forward movable head 32 and the rear of the unit. The distance can be lengthened or shortened via the adjustable extension frame.

The operation of the pneumatic carpet stretcher 10 of the present invention typically requires low volumes of compressed air at delivery pressures from 50 psi to 100 psi. These pressures and capacities are consistent with low priced, mass market, portable compressor units, ubiquitous on job sites. Overall, the pneumatic carpet stretcher 10 even weighs less than conventional manual "power stretchers" rated with similar capacities.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A carpet stretcher for stretching carpet, the carpet stretcher comprising:

a gripping portion having a first end and a second end;

a pneumatic portion having a first end and a second end;

an interchangeable moving head releasably secured to the first end of the gripping portion, the moving head having a plurality of gripping mechanisms for gripping the carpet;

a pneumatic actuator assembly mounted to the pneumatic portion and securing the first end of the pneumatic portion to the second end of the gripping portion, the pneumatic actuator selectively moving the gripping portion in a general direction away from and toward the pneumatic portion, the pneumatic actuator assembly having a rear plate, a front plate spaced from the rear plate, a pair of pneumatic cylinders coupled to the rear plate, each pneumatic cylinder having a movable piston extendable from the pneumatic cylinders, a pair of apertures formed in the rear plate, the piston movable in a generally forward direction and reverse direction through the apertures;

a compressed air line extending from a compressed air source to the pneumatic actuator assembly; and a trigger mechanism for selectively introducing compressed air to the pneumatic actuator assembly;

wherein the pistons are secured to the front plate causing the front plate to move in conjunction with the pneumatic cylinders; and wherein as the trigger mechanism is actuated, the interchangeable head moves away from the pneumatic portion causing the carpet to be stretched.

2. The carpet stretcher of claim 1 and further comprising:

a slot formed in the gripping portion for receiving a pin mounted on the front plate for contacting the second end of the gripping portion such that as the pneumatic cylinders cause the pistons to extend, the front plate also extends causing the gripping portion to extend from the pneumatic portion thereby stretching the carpet.

3. The carpet stretcher of claim 1 and further comprising:

a knee portion having a first end and a second end, the first end of the knee portion receivable and movable in and out of the second end of the pneumatic portion.

4. The carpet stretcher of claim 3 and further comprising:

an air shock at a connection between the pneumatic portion and the knee portion providing resistance during activation of the pneumatic actuator assembly.

5. The carpet stretcher of claim 3 and further comprising:

a padded knee pad mounted to the second end of the knee portion.

6. The carpet stretcher of claim 5 wherein the knee pad includes an actuator trigger embedded therein for actuating the pneumatic actuator assembly and a coupling extending from the knee pad to the compressed air source, the compressed air line extending from the compressed air source to the knee pad to the pneumatic actuator assembly.

7. The carpet stretcher of claim 1 and further comprising:

a handle mounted to the pneumatic portion and graspable by a user during operation.

8. The carpet stretcher of claim 7 and further comprising:

a wheel mounted opposite the handle to the gripping portion allowing the pneumatic carpet stretcher to roll during stretching and relaxing of the carpet.

9. The carpet stretcher of claim 1 and further comprising:

an interchangeable thrust plate mounted to the second end of the pneumatic portion and positionable against fixed objects.

10. The carpet stretcher of claim 9 and further comprising:

an actuator trigger positioned on or near the pneumatic actuator assembly cylinders to extend and retract the gripping head.

11. The carpet stretcher of claim 9 wherein the distance between the thrust plate and the pneumatic portion is adjustable.

12. The carpet stretcher of claim 1 and further comprising:

an operating stand mounted to the second end of the pneumatic portion.

13. The carpet stretcher of claim 12 and further comprising:

an elongated rear handle mounted between the pneumatic portion and the operating stand; and an actuator trigger is positioned on the elongated rear handle for activating the compressed air source to extend and retract the gripping head.

14. The carpet stretcher of claim 12 wherein the distance between the operating stand and the pneumatic portion is adjustable.

15. A carpet stretcher for stretching carpet, the carpet stretcher comprising:

a gripping portion having a first end and a second end;

a pneumatic portion having a first end and a second end;

an interchangeable moving head releasably secured to the first end of the gripping portion, the moving head having a plurality of gripping mechanisms for gripping the carpet;

a pneumatic actuator assembly mounted to the pneumatic portion and securing the first end of the pneumatic portion to the second end of the gripping portion, the pneumatic actuator selectively moving the gripping portion in a general direction away from and toward the pneumatic portion;

a compressed air line extending from a compressed air source to the pneumatic actuator assembly;

a trigger mechanism for selectively introducing compressed air to each of the pneumatic cylinders;

a knee portion having a first end and a second end, the first end of the knee portion receivable and movable in and out of the second end of the pneumatic portion;

a padded knee pad mounted to the second end of the knee portion;

wherein as the trigger mechanism is actuated, the interchangeable head moves away from the pneumatic portion causing the carpet to be stretched; and wherein the knee pad includes an actuator trigger embedded therein for actuating the pneumatic actuator assembly and a coupling extending from the knee pad to the compressed air source, the compressed air line extending from the compressed air source to the knee pad to the pneumatic actuator assembly.

16. A carpet stretcher for stretching carpet, the carpet stretcher comprising:

a gripping portion having a first end and a second end;

a pneumatic portion having a first end and a second end;

an interchangeable moving head releasably secured to the first end of the gripping portion, the moving head having a plurality of gripping mechanisms for gripping the carpet;

a pneumatic actuator assembly mounted to the pneumatic portion and securing the first end of the pneumatic portion to the second end of the gripping portion, the pneumatic actuator selectively moving the gripping portion in a general direction away from and toward the pneumatic portion;

a compressed air line extending from a compressed air source to the pneumatic actuator assembly;

a trigger mechanism for selectively introducing compressed air to each of the pneumatic cylinders;

a handle mounted to the pneumatic portion and graspable by a user during operation; and a wheel mounted opposite the handle to the gripping portion allowing the pneumatic carpet stretcher to roll during stretching and relaxing of the carpet;

wherein as the trigger mechanism is actuated, the interchangeable head moves away from the pneumatic portion causing the carpet to be stretched.

17. A carpet stretcher for stretching carpet, the carpet stretcher comprising:

a gripping portion having a first end and a second end;

a pneumatic portion having a first end and a second end;

an interchangeable moving head releasably secured to the first end of the gripping portion, the moving head having a plurality of gripping mechanisms for gripping the carpet;

a pneumatic actuator assembly mounted to the pneumatic portion and securing the first end of the pneumatic portion to the second end of the gripping portion, the pneumatic actuator selectively moving the gripping portion in a general direction away from and toward the pneumatic portion;

a compressed air line extending from a compressed air source to the pneumatic actuator assembly;

a trigger mechanism for selectively introducing compressed air the pneumatic cylinders;

an operating stand mounted to the second end of the pneumatic portion;

wherein as the trigger mechanism is actuated, the interchangeable head moves away from the pneumatic portion causing the carpet to be stretched; and wherein the distance between the operating stand and the pneumatic portion is adjustable.

* * * * *